United States Patent [19]

Weatherston

[11] 3,941,521

[45] Mar. 2, 1976

[54] ROTARY COMPRESSOR

[75] Inventor: Roger C. Weatherston, Williamsville, N.Y.

[73] Assignee: Calspan Corporation, Buffalo, N.Y.

[22] Filed: Aug. 28, 1974

[21] Appl. No.: 501,034

[52] U.S. Cl. ..... 418/9; 418/206

[51] Int. Cl.[2] ..... F04C 13/00; F04C 17/10

[58] Field of Search ..... 418/9, 201, 205, 206

[56] References Cited

UNITED STATES PATENTS

| | | | |
|---|---|---|---|
| 158,277 | 12/1874 | Holcomb et al. | 418/201 |
| 2,515,201 | 7/1950 | Dulmage et al. | 418/201 X |
| 2,670,188 | 2/1954 | Erdmenger | 418/201 X |
| 2,839,240 | 6/1958 | Bechtold | 418/9 |

FOREIGN PATENTS OR APPLICATIONS

| | | | |
|---|---|---|---|
| 106,899 | 6/1927 | Austria | 418/201 |
| 200,547 | 7/1923 | United Kingdom | 418/201 |

*Primary Examiner*—C. J. Husar
*Assistant Examiner*—Leonard Smith
*Attorney, Agent, or Firm*—Allen J. Jaffe

[57] ABSTRACT

A rotary compressor having a pair of rotatable impellers in mating engagement in working chambers, each impeller having a plurality of constant cross-sectional profiles, each profile having a plurality of lobes and wells, the trailing well region of each profile communicating with the leading well region of an adjacent profile, an inlet communicating with the working chambers and an outlet located out of the plane of at least one of the profiles on each impeller.

12 Claims, 4 Drawing Figures

ROTARY COMPRESSOR

The present invention relates to rotary compressors and, more particularly, to a rotary compressor so constructed and arranged as to provide an efficiency increasing precompression of the fluid in each of the working chambers prior to the fluid's exposure to the discharge passage.

Presently, there are generally two types of rotary compressors that have noncontacting working members which act upon the fluid. These are of the roots-type and the screw-type. The main advantages of both of these apparatus is that there is no need for lubrication and the fluid compression process may be absolutely oil free. However, both the roots-type and the screw-type of compressor have undersirable intrinsic characteristics which are overcome according to the teachings of the present invention. The roots compressor has a simple two-dimensional impeller profile but because there is no precompression of the fluid the compression process is relatively inefficient, being only 75% at a compression ratio of two and 65% at a compression ratio of three even if all tare and leakage losses are neglected. The screw compressor, on the other hand, has a complicated three-dimensional contour which is very expensive to manufacture and which gives rise to high internal leakage losses.

The foregoing disadvantages of the prior apparatus are overcome according to the teachings of the present invention which provides a rotary fluid compressor that is efficient and inexpensive to manufacture.

In copending U.S. application Ser. No. 441,929, filed Feb. 12, 1974 for Rotary Compressor now U.S. Pat. No. 3,844,695 and assigned to the assignee of the present invention, there is disclosed various embodiments for obtaining a precompression of the working fluid prior to its exposure to the discharge passage. One of these embodiments depicts a pair of impellers each having two profiles, one in the plane of the discharge port and the other in a plane spaced therefrom. One profile in the plane of the discharge port functions to cyclically seal the discharge port to thereby permit fluid in both working chambers to experience a simultaneous increase in pressure prior to exposure to the discharge port. A precompression is thereby achieved simultaneously in both working chambers.

The present invention, on the other hand, provides apparatus which permits the fluid in each working chamber to undergo separate precompressions. Thus, fluid is precompressed in each working chamber independently of the action in the other working chamber. Moreover, the discharge port is always receiving fluid from one of the two working chambers. In this manner the flow of discharge fluid is continuous resulting in an increased compressor efficiency and smoother operation.

Basically the present invention provides a pair of coacting impellers each having two or more constant cross-sectional profiles at least one of which is out of the plane of the discharge port. Each profile has one or more lobes and one or more wells, with the lobes of any one profile angularly displaced from those of the profile immediately adjacent thereto. The arrangement is such that inlet fluid sequentially passes through and is progressively trapped in the decreasing total well volume of the profiles prior to exposure to the discharge port. The pressure of the fluid is therefore increased above that of the inlet prior to communication between the well or wells of the profile in the plane of the discharge port and the discharge port.

For a fuller understanding of the present invention reference should now be had to the following detailed description thereof taken in conjunction with the accompanying drawings wherein.

Figure 1:
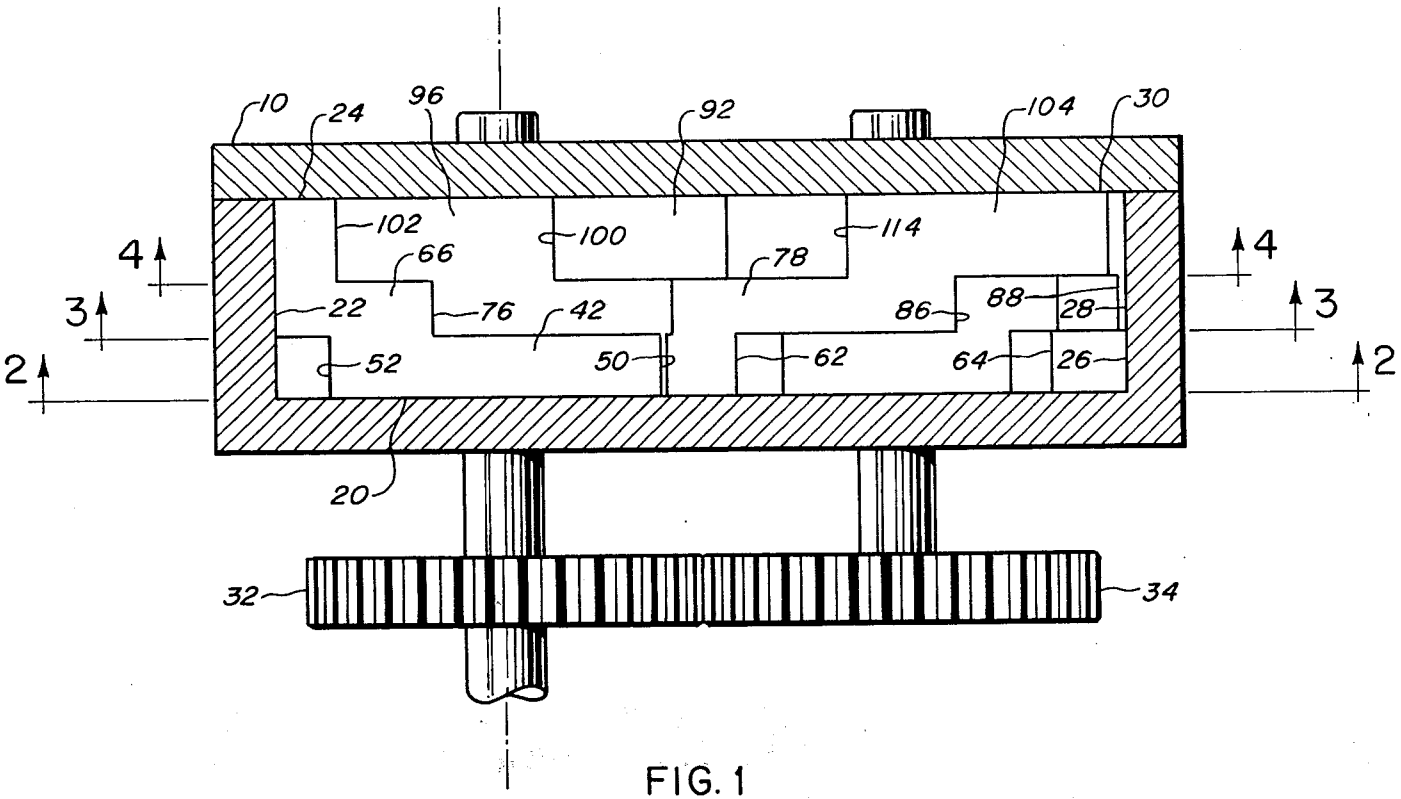
FIG. 1 is a plan sectional schematic of the compressor impellers taken along line 1 — 1 of FIG. 2.

Referring now to the drawings, a housing 10 provides a pair of working chambers 12 and 14 which, respectively, receive a pair of rotatable, mating impellers 16 and 18. Impeller 16 is suitably mounted for rotation in the direction of arrow A and is comprised of a plurality of two dimensional or constant cross-sectional profiles 20, 22 and 24. Similarly, impeller 18 is suitably mounted for rotation in the direction of arrow B and is comprised of a plurality of two dimensional or constant cross-sectional profiles 26, 28 and 30. Profiles 20 and 26, 22 and 28 and 24 and 30 are complimentary and are in mating engagement. Although three profiles are shown on each impeller, this is for illustrative purposes only and it is within the purview of the present invention to provide a lesser or greater number of profiles. Impellers 16 and 18 may be driven and timed by a pair of gears 32 and 34, as is conventional.

Figure 4:
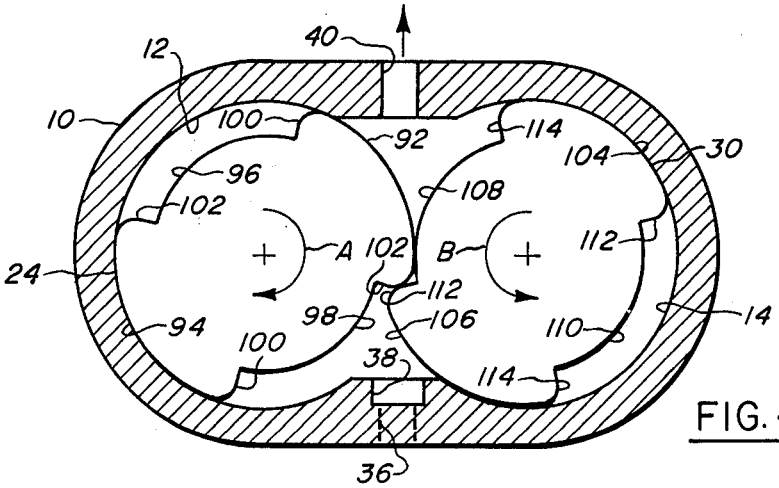
FIG. 4 is a sectional view taken along line 4 — 4 of FIG. 1.

An inlet passage 36 communicates with each working chamber substantially along the entire depths thereof by means of a slot or the like 38, whereas a discharge port or passage 40 communicates with each working chamber only in the plane of impeller profiles 24 and 30 as illustrated in FIG. 4.

Profile 20 is comprised of a plurality of lobes 42 and 44 with a plurality of wells 46 and 48 therebetween. The lobes 42 and 44 are sealingly engaged with the interior surface of working chamber 12 and are joined to the wells 46 and 48 by concave transition surfaces 50 and 52. Similarly, profile 26 is comprised of a plurality of lobes 54 and 56 with a plurality of wells 58 and 60 therebetween. The lobes 54 and 56 are sealingly engaged with the interior surfaces of working chamber 14 and are joined to the wells 58 and 60 by concave transition surfaces 62 and 64. Lobes 42 and 44 respectively engage and mate with wells 58 and 60 whereas lobes 54 and 56 respectively engage and mate with wells 46 and 48.

Profile 22 adjacent profile 20 is comprised of a plurality of lobes 66 and 68 with a plurality of wells 70 and 72 therebetween. The lobes 66 and 68 are sealingly engaged with the interior surfaces of working chamber 12 and are joined to the wells 70 and 72 by concave transition surfaces 74 and 76. Similarly, profile 28 is comprised of a plurality of lobes 78 and 80 with a plurality of wells 82 and 84 therebetween. The lobes 78 and 80 are sealingly engaged with the interior surfaces of working chamber 14 and are joined to the wells 82 and 84 by concave transition surfaces 86 and 88. Lobes 66 and 68 respectively engage and mate with wells 82 and 84 whereas lobes 78 and 80 respectively engage and mate with wells 72 and 70.

Profiles 20 and 26 are angularly displaced from profiles 22 and 28 such that trailing regions of wells 46 and 48 and 58 and 60 overlap and communicate respectively with the leading regions of wells 70 and 72 and 82 and 84. As used herein the term "trailing region" means the region or well volume that is last to pass under the cusp 90 at the joinder of the two working chambers whereas the term "leading region" means the region or well volume that is first to pass under the cusp 90.

Profile 24 adjacent profile 22 is comprised of a plurality of lobes 92 and 94 with a plurality of wells 96 and 98 therebetween. The lobes 92 and 94 are sealingly engaged with the interior surfaces of working chamber 12 and are in the plane of and pass under discharge port 40 to deliver thereto the fluid contained in wells 96 and 98. The lobes 92 and 94 are joined to the wells 96 and 98 by convex transition surfaces 100 and 102. Similarly, profile 30 is comprised of a plurality of lobes 104 and 106 with a plurality of wells 108 and 110 therebetween. The lobes 104 and 106 are sealingly engaged with the interior surfaces of working chamber 14 and are in the plane of and pass under discharge port 40 to deliver thereto the fluid contained in wells 108 and 110. The lobes 104 and 106 are joined to the wells 108 and 110 by convex transition surfaces 112 and 114.

Profiles 24 and 30 are angularly displaced from profiles 22 and 28 such that the trailing regions of wells 70 and 72 and 82 and 84 overlap and communicate respectively with the leading regions of wells 96 and 98 and 110 and 108.

Moreover, the degree of overlap or relative angular displacement between profiles 24 and 20 is such that when leading transition surface 100 becomes exposed to the discharge or outlet, transition surface 52 will have already gone through the mating position. The same relationship is true for profiles 30 and 26.

Although each profile has been depicted as having two lobes and two wells, it is to be understood that this has been for illustrative purposes only and additional lobes and wells can be provided.

Figure 2:
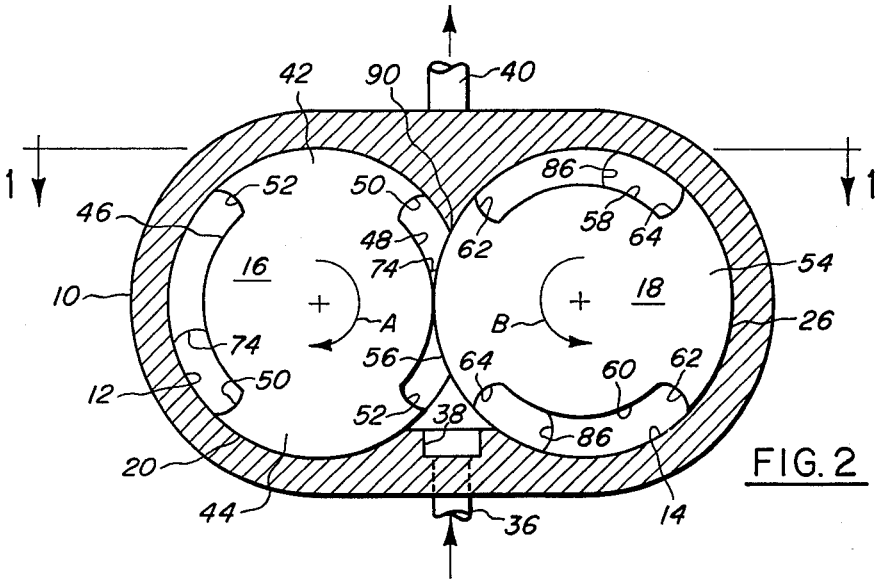
FIG. 2 is a sectional view taken along line 2 — 2 of FIG. 1.

In the operation of the apparatus according to the present invention, inlet fluid is delivered via port 36 and slot 38 to each of the wells or well volumes of each profile as they become exposed to the inlet region. Thus, as shown in FIG. 2, well 60 has just about fully charged with inlet fluid whereas well 84 (FIG. 3) is in the process of being filled and well 108 (FIG. 4) has not yet become exposed to the inlet. The wells 58, 82 and 110 all contain fluid at inlet pressure trapped therein. It is therefore clear that in the illustrated position of impellers the well volumes of each profile contain trapped fluid at inlet pressure. As well 58 passes under cusp 90 and mates with lobe 42 the fluid contained therein is forced into well 82 of the adjacent profile via the overlap between the two profiles 26 and 28. Since the same amount of fluid now occupies a smaller volume the pressure of the fluid increases above that of the inlet. A second precompression of the fluid similarly occurs when well 82 passes under cusp 90 and mates with lobe 66 in that the fluid in well 82 is now forced into well 110 of the adjacent profile via the overlap between the profiles 28 and 30. Thus the fluid at inlet pressure in the three well volumes now exists at an elevated pressure in only one well volume. As the fluid in well 110 is exposed to the outlet 40 and well 110 coacts with lobe 94 the gas is forced out of the discharge in a conventional manner.

Although the foregoing operation has been described with respect to one well of each profile of each impeller it should be apparent that the same action occurs in the other well of each profile and in each well of the profiles of the other impeller. Thus for the illustrated apparatus there are four separate total precompressions of the fluid, prior to its exposure to the outlet, for each cycle or revolution of the impellers. It should be further apparent that the precompressions occur in each working chamber independently. There is no need or requirement that fluid be transferred from one working chamber to the other in order to achieve the efficiency increasing precompression.

Figure 3:
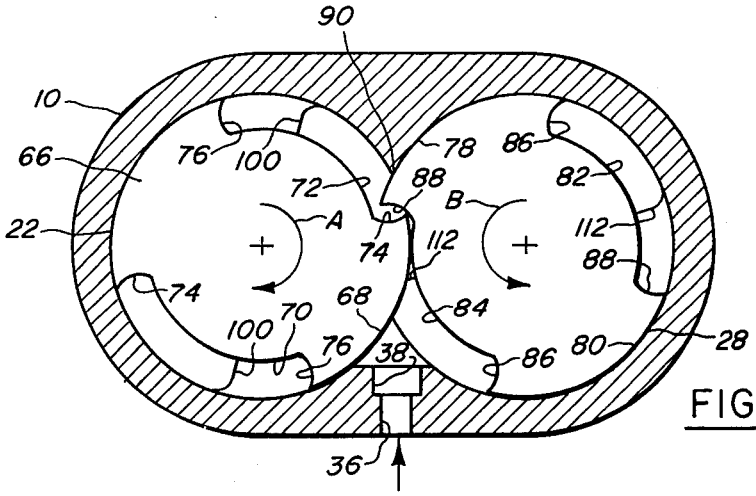
FIG. 3 is a sectional view taken along line 3 — 3 of FIG. 1.

It is important to note that the transition surfaces 50, 52; 62, 64; and 74, 76 on the profiles which are out of the plane of the outlet 40 are substantially concave in shape whereas the transition surfaces 100, 102 and 112, 114 on the profile in the plane of the outlet can be more arbitrary in shape and are shown to be substantially convex. The reason for the concave transition surfaces is explained as follows: When the wells of profiles 24 and 30 are exposed to the high pressure outlet, as is well 108 in FIG. 4, it is necessary to prevent high pressure fluid leaking back to low pressure well 72 through well 108 as leading edge 88 mates with trailing edge 74. As can be seen in FIG. 3 due to their concave shape the tip of edge 74 seals throughout the entire side face of surface 88 to thereby block flow from well 108 to well 72. If edge 88 was not concave such a sealing action could not be attained and there would be an interstage leak. Likewise edges 50, 64 and 76 must also be concave to provide this interstage sealing action.

Although a preferred embodiment of the present invention has been disclosed and described, changes will obviously occur to those skilled in this art. It is therefore intended that the scope of the present invention be limited only by the scope of the appended claims.

I claim:

1. A rotary compressor, comprising;
a. a housing defining two working chambers,
b. mating impellers rotatably mounted in each of said working chambers,
c. each impeller having at least two constant cross-sectional profiles,
d. each of said profiles comprised of at least one lobe and at least one well,
e. the lobes and wells of any one profile being angularly displaced from those of the profile immediately adjacent thereto,
f. inlet passage means extending substantially the entire length of said working chambers for communication with substantially all of said profiles, and
g. outlet passage means having a port located in the plane containing substantially one pair of profiles.

2. A rotary compressor, comprising;
a. a housing providing a pair of working chambers,
b. an inlet port communicating with an inlet region of said working chambers,
c. an outlet port communicating with an outlet region of said working chambers,
d. an impeller rotatably mounted in each of said working chambers for rotation in opposite directions,
e. each impeller having at least two constant cross-sectional profiles, f. adjacent ones of said profiles on each impeller being angularly displaced with respect to each other, g. at least one of said profiles being out of the plane of said outlet port and at least one of the others of said profiles being in the plane thereof, and h. said inlet region communicating substantially with all of said profiles.

3. The compressor according to claim 2, wherein;

i. each of said profiles comprise at least one lobe and at least one well, and j. the lobes and wells of any one profile being angularly displaced from those of the profile immediately adjacent thereto whereby, as said impellers rotate, fluid is transferred sequentially from the wells of one profile to the wells of adjacent profiles and experiences an increase in pressure prior to the establishment of communication between said outlet port and the wells of the profiles in the plane thereof.

4. The compressor according to claim 3, wherein;

k. said lobes and wells of each profile have substantially cylindrical outer peripheral surfaces.

5. The compressor according to claim 4, wherein;

l. at least said lobes and wells of the profiles out of the plane of said outlet port being joined by substantially concave transition surfaces.

6. A rotary compressor, comprising;

a. a housing b. mating impellers rotatably mounted in said housing for rotation in opposite directions, c. each impeller having at least two constant cross-sectional profiles.

d. each of said profiles comprised of at least one lobe and at least one well, e. the lobes and wells of any one profile being angularly displaced from those of the profile immediately adjacent thereto, f. inlet passage means communicating with said housing providing fluid communication with substantially all of said profiles and direct communication with at least more than one of said profiles, g. outlet passage means communicating with said housing, and h. at least one of said profiles being out of the plane of said outlet passage means and at least one of the others of said profiles being in the plane thereof.

7. The compressor according to claim 6, wherein;

i. said lobes and wells of each profile having substantially cylindrical outer peripheral surfaces.

8. The compressor according to claim 7, wherein;

j. at least said lobes and wells of the profiles out of the plane of said outlet passage means being joined by substantially concave transition surfaces.

9. A rotary compressor, comprising;

a. a housing b. a pair of mating impellers rotatably mounted in said housing for rotation in opposite directions, c. each of said impellers comprised of a plurality of constant cross-sectional profiles, d. each profile comprised of at least one lobe and at least one well e. each of said wells having a leading well volume and a trailing well volume, the trailing well volumes of any profile on any impeller overlapping and in fluid communication with the leading well volumes of the profile on the same impeller with is adjacent thereto whereby as the impellers rotate fluid is sequentially transferred from the well volumes of one profile to the well volumes of adjacent profiles, g. inlet passage means communicating with said housing for providing fluid communication with substantially all of said profiles and direct communication with at least more than one of said profiles, h. an outlet communicating with said housing and located out of the plane of at least one of said profiles and located in the plane of at least one of the others of said profiles.

10. The compressor according to claim 9, further comprising;

g. an inlet communicating with said housing for delivering inlet fluid to each of said wells, and h. an outlet communicating with said housing and located out of the plane of at least one of said profiles and located in the plane of at least one of the others of said profiles.

11. The compressor according to claim 9, wherein;

i. said lobes and wells having substantially cylindrical peripheral surfaces.

12. The compressor according to claim 11, wherein;

j. at least said lobes and wells of the profiles out of the plane of said outlet being joined by substantially concave transition surfaces.

* * * * *